US011787594B2

(12) United States Patent
Lau

(10) Patent No.: US 11,787,594 B2
(45) Date of Patent: Oct. 17, 2023

(54) FOOD RECEPTACLE

(71) Applicant: MICROWAVE PACKAGING (S) PTE. LTD., Singapore (SG)

(72) Inventor: Boon Wee Lau, Singapore (SG)

(73) Assignee: Microwave Packaging (S) PTE. LTD., Singapore (SG)

( * ) Notice: Subject to any disclaimer, the term of this patent is extended or adjusted under 35 U.S.C. 154(b) by 143 days.

(21) Appl. No.: 17/433,496

(22) PCT Filed: Feb. 25, 2019

(86) PCT No.: PCT/SG2019/050102
§ 371 (c)(1),
(2) Date: Aug. 24, 2021

(87) PCT Pub. No.: WO2020/176034
PCT Pub. Date: Sep. 3, 2020

(65) Prior Publication Data
US 2022/0185531 A1 Jun. 16, 2022

(51) Int. Cl.
*B65D 5/20* (2006.01)
*B65D 5/66* (2006.01)

(52) U.S. Cl.
CPC ..... *B65D 5/2057* (2013.01); *B65D 5/667* (2013.01); *B65D 5/6608* (2013.01); *B65D 2251/1025* (2013.01)

(58) Field of Classification Search
CPC ..... B65D 5/2057; B65D 5/665; B65D 5/667; B65D 5/2047; B65D 5/6608; B65D 5/6655
(Continued)

(56) References Cited

U.S. PATENT DOCUMENTS 3,744,705 A * 7/1973 Kuhn ..... A45C 5/02 229/148
4,516,718 A * 5/1985 Forbes, Jr. ..... B65D 5/6626 229/148
(Continued)

FOREIGN PATENT DOCUMENTS

KR 20210075497 A * 6/2021

OTHER PUBLICATIONS

PCT International Search Report and Written Opinion; Application No. PCT/SG2019/050102, International filing date of Feb. 25, 2019 Microwave Packaging (S) Pte Ltd, dated May 20, 2019, 8 pages.
(Continued)

*Primary Examiner* — Nathan J Newhouse
*Assistant Examiner* — Phillip D Schmidt
(74) *Attorney, Agent, or Firm* — PATENT LAW WORKS LLP

(57) ABSTRACT

A food receptacle having a tray with a base, a perimeter wall extending therefrom, and a tongue extending from the perimeter wall along a longitudinal axis and a cover adapted to cover the tray. Cover has an opening adapted to receive the tongue therethrough, such that the tongue is inserted through the opening when the tray is covered by the cover. Tongue may include a protrudable portion adapted to protrude away from the longitudinal axis. When protruded, the protrudable portion is adapted to abut the cover. When the tray is covered by the cover, the protrudable portion may be protruded over the top panel to prevent the tongue from being withdrawn from the opening.

8 Claims, 8 Drawing Sheets

(58) Field of Classification Search
USPC ..... 229/141, 145, 147, 148, 154, 102, 114, 229/125.27, 125.28, 125.29, 146, 153, 229/902, 906
See application file for complete search history.

(56) References Cited

U.S. PATENT DOCUMENTS

| | | | | |
|---|---|---|---|---|
| 5,044,549 | A * | 9/1991 | Beales | B65D 5/6697 229/148 |
| 5,226,587 | A * | 7/1993 | Eisman | B65D 5/68 229/148 |
| 5,908,152 | A * | 6/1999 | Tullis | B65D 5/2047 229/148 |
| 7,980,452 | B2 * | 7/2011 | Burton | B65D 5/667 229/148 |
| 9,278,774 | B2 | 3/2016 | Fairchild, Jr. | |
| 11,040,797 | B2 * | 6/2021 | Zeiler | B65D 5/106 |
| 11,186,406 | B2 * | 11/2021 | Chapman | B65D 5/667 |
| 11,465,798 | B2 * | 10/2022 | Epstein | B65D 5/667 |
| 2008/0302808 | A1 | 12/2008 | Maxwell | |
| 2010/0032475 | A1 | 2/2010 | Burton | |

OTHER PUBLICATIONS

PCT International Preliminary Report on Patentability with Demand, Application No. PCT/SG2019/050102, International Filing Date Feb. 25, 2019, Microwave Packaging (S) Pte. Ltd., Completion date of report Nov. 15, 2019, 17 pgs.

* cited by examiner

FOOD RECEPTACLE

CROSS REFERENCE TO RELATED APPLICATIONS

This application is a national phase entry under 35 U.S.C. § 371 of International Patent Application PCT/SG2019/050102, filed Feb. 25, 2019, designating the United States of America and published in English as International Patent Publication WO 2020/176034 on Sep. 3, 2020, the entireties of which are hereby incorporated by reference.

TECHNICAL FIELD

The present invention relates to a food receptacle. For example, a food receptacle with a locking mechanism.

BACKGROUND

It is very common nowadays to use a food box to pack food for takeaways. Typically, the food box for takeaways is made from paper or foam. Due to environmental issues, paper is preferred and more commonly used. The food box may include a tray to contain the food, a top cover to cover the tray and a locking mechanism disposed on food box to lock the cover to the tray. However, as the material used for the box is not durable, it is frequent that the locking mechanism of the box is damaged or does not function properly when the food is packed and therefore the box may not be covered properly. Often, a binder, e.g. rubber band or adhesive tape, is used to prevent the box from opening up. At times, after opening and closing the cover for a few times, the locking mechanism may deteriorate and become damaged.

Besides the above problem, the food box may not be stackable is the content is relatively heavy. When the food boxes containing dense food are being stacked onto each other, the food boxes at the bottom may collapse and flatten under the weight of the food boxes above. As a result, the food within may spill out of the food box, creating a mess and the food becomes unconsumable.

It is thus an object of the present invention to improve or resolve the aforementioned problems, i.e. to provide a food box with a durable and effective locking mechanism to secure the cover of the food box.

SUMMARY

According to various embodiments, a food receptacle is provided. Food receptacle includes a tray having a base, a perimeter wall extending therefrom, and a tongue extending from the perimeter wall along a longitudinal axis, a cover adapted to cover the tray, the cover includes an opening adapted to receive the tongue therethrough, such that the tongue is inserted through the opening when the tray is covered by the cover, such that the tongue comprises a protrudable portion adapted to protrude away from the longitudinal axis, such that, when protruded, the protrudable portion is adapted to protrude over the cover, and such that when the tray is covered by the cover, the protrudable portion is protruded to prevent the tongue from being withdrawn from the opening.

According to various embodiments, the cover may be pivotally attached to the tray.

According to various embodiments, the cover may include a top panel and a front panel extending from the top panel, such that the opening may be disposed on the front panel.

According to various embodiments, the opening may be disposed adjacent the top panel.

According to various embodiments, the protrudable portion may be adapted to rotate away from the perimeter wall of the tray.

According to various embodiments, the tongue may include a body and the protrudable portion may be pivotally connected to the body.

According to various embodiments, the protrudable portion may be disposed within the body and adapted to rotate out of the body.

According to various embodiments, the body may include a front side and a rear side behind the front side, such that the protrudable portion may be adapted to rotate from the front side or the rear side.

According to various embodiments, the tongue may include a window within and having a top edge, such that the protrudable portion may be housed within the window and pivotally attached to the top edge of the window.

According to various embodiments, the perimeter wall may include a window connected to the tongue, such that the protrudable portion extends from the tongue and housed within the window.

According to various embodiments, the tongue may be foldable, such that the protrudable portion may be protruded when the tongue is folded.

DETAILED DESCRIPTION

Figure 1:
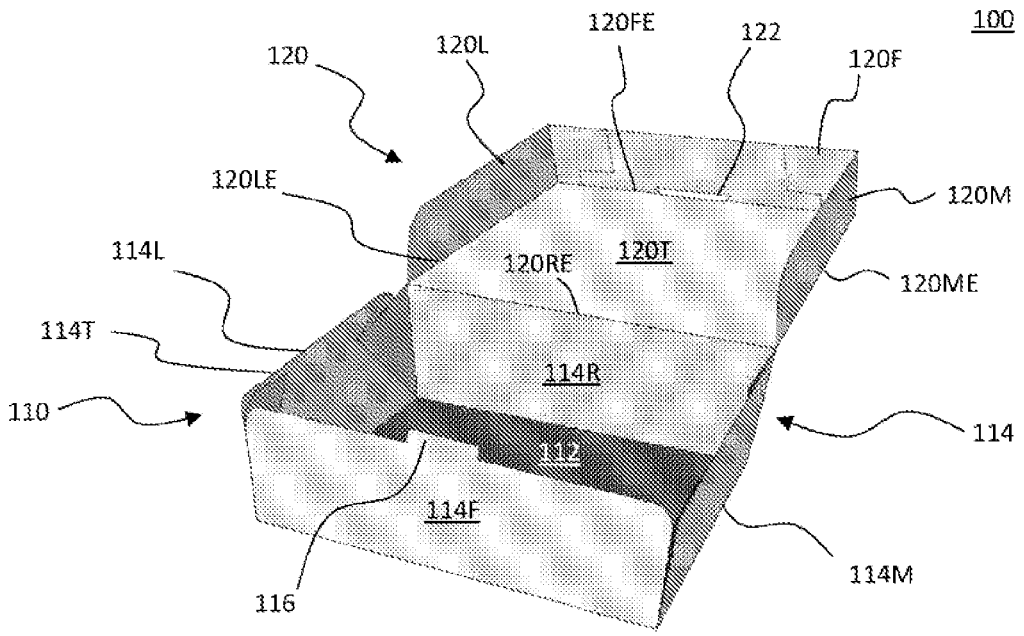
FIG. 1 shows a perspective view of an exemplary embodiment of the food receptacle.

FIG. 1 shows a perspective view of an exemplary embodiment of the food receptacle 100. Food receptacle 100 may include a tray 110 having a base 112, a perimeter wall 114 extending therefrom, and a tongue 116 extending from the perimeter wall 114. Food receptacle 100 may include a cover 120 adapted to cover the tray 110. Cover 120 may include an opening 122 adapted to receive the tongue 116 therethrough, such that the tongue 116 is inserted through the opening 122 when the tray 110 is covered by the cover 120 (as shown in FIG. 2).

Base 112 of the tray 110 may be of a quadrilateral shape, e.g. a square, rectangular, or a shape of another number of sides, e.g. pentagonal, hexagonal. Accordingly, the perimeter wall 114 which extends from the base 112 will have the same number of sides of the base 112. Referring to FIG. 1, the base 112 may be rectangular such that the perimeter wall 114 may have four planar walls, i.e. the front wall 114F, rear wall 114R opposite the front wall 114F, a left side wall 114L and a right side wall 114M. The left side wall 114L and the right side wall 114M may extend from the front wall 114F to the rear wall 114R and spaced from each other. Perimeter wall 114 may include a perimeter edge 114T formed by the top edges of the front wall 114F, the rear wall 114R, the left side wall 114L and the right side wall 114M. Tongue 116 may extend upwardly from the front wall 114F. The four walls 114F,114R,114L,114M may have the same height such that the top edge of each of the four walls 114F,114R,114L, 114M are disposed within a plane. In this way, the top panel 120T may be in contact with the perimeter wall 114 when the tray 110 is covered by the cover 120. The four walls 114F,114R,114L,114M may be of different heights, e.g. the front wall 114F and the rear wall 114R may be taller than the left side wall 114L and the right side wall 114M. The four walls 114F,114R,114L,114M may lean outwardly from the base 112 such that each wall may form an obtuse angle with the base 112. Alternatively, two of the four walls 114F,114R, 114L,114M may be perpendicular to the base 112 and the other two of the four walls 114F,114R,114L,114M may form an obtuse angle with the base 112. By having a perimeter wall 114 that leans outwardly from the base 112, the perimeter wall 114 is prevented from collapsing towards the centre of the tray 110. As will be explained later, the perimeter wall 114 will be refrained from leaning away from the base 112 when the tray 110 is covered so as to provide a rigid structure to take heavier load on the food receptacle 100.

Cover 120 may include a top panel 120T. Top panel 120T may have a shape that corresponds to the shape of the base 112. As shown in FIG. 1, the top panel 120T may be rectangular having a front edge 120FE, a rear edge 120RE opposite the front edge 120FE and a left edge 120LE and a right edge 120ME, both the left edge 120LE and the right edge 120ME extend from the front edge 120FE to the right edge 120ME. Cover 120 may have a front panel 120F extending from the front edge 120FE, a left side panel 120L extending from the left edge 120LE and a right side panel 120M extending from right edge 120ME. Cover 120 may be pivotally connected to the perimeter wall 114 via the rear edge 120RE. Left side panel 120L and the right side panel 120M may be connected to the front panel 120F to provide structural rigidity to the front panel 120F. The three panels, i.e. the front panel 120F, the left side panel 120L, the right side panel 120M, may have the same height such that the bottom edge of each panel may be disposed within a plane. The three panels 120F,120L,120M may have different heights. For example, the front panel 120F may be taller than the left side panel 120L and the right side panel 120M. Cover 120 may be pivotally connected to the tray 110 along one edge of the top panel 120T, e.g. the rear edge 120RE of the top panel 120T, and rotatable between an opened position where the tray 110 is not covered by the cover 120 as shown in FIG. 1 and in a covered position where the tray 110 is covered by the cover 120 as shown in FIG. 2. Cover 120 may be pivotally connected to the tray 110 at the rear wall 114R thereof. Alternatively, the cover 120 may be separated from the tray 110 as a two-piece configuration such that the cover 120 may have a rear panel opposite the front panel 120F and the left side panel 120L and the right side panel 120M extending from the front panel 120F to the rear panel. Front panel 120F may be tapered away from the top panel 120T such that the front panel 120F may form an obtuse angle with the top panel 120T. Left side panel 120L and the right side panel 120M may also be tapered away from the top panel 120T such that the left side panel 120L and the right side panel 120M may form an obtuse angle with the top panel 120T. Top panel 120T may be of the same size and shape as the area and shape formed by the perimeter edge 114T of the perimeter wall 114 of the tray 110 such that the perimeter edge 114T of the perimeter wall 114 may coincide with the perimeter of the top panel 120T.

Figure 2:
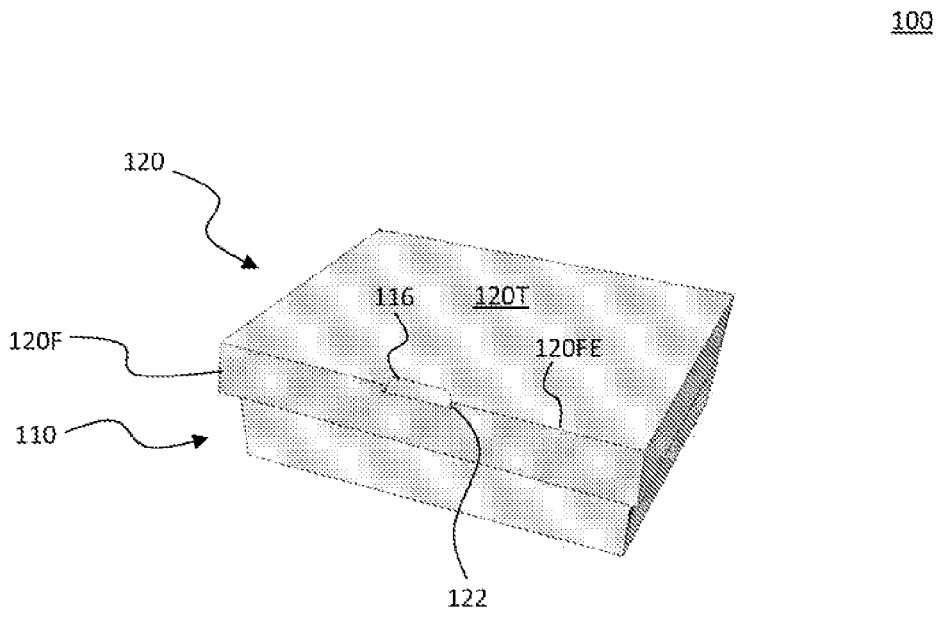
FIG. 2 shows a perspective view of the food receptacle in FIG. 1 in the closed position.

FIG. 2 shows a perspective view of the food receptacle 100 in FIG. 1 in the closed position. As shown in FIG. 2, when the tray 110 is covered by the cover 120, the tongue 116 is inserted through the opening 122 and adapted to engage the cover 120 such that the cover 120 is retained in the covering position, i.e. covering the tray 110. Opening 122 may be disposed on the front panel 120F and aligned with the tongue 116 such that the opening 122 is displaced towards the tongue 116 when the cover 120 is being displaced towards the tray 110. Opening 122 may be disposed adjacent the front edge 120FE of the top panel 120T. In this way, it is easier for the tongue 116 to locate the opening 122 when it is adjacent the front edge 120FE. Alternatively, the opening 122 may be disposed at the top panel 120T adjacent the front edge 120FE of the top panel 120T. It is preferred to have the opening 122 on the front panel 120F than on the top panel 120T as it is less likely to have contaminants fall into the food receptacle 100.

Figure 2A:
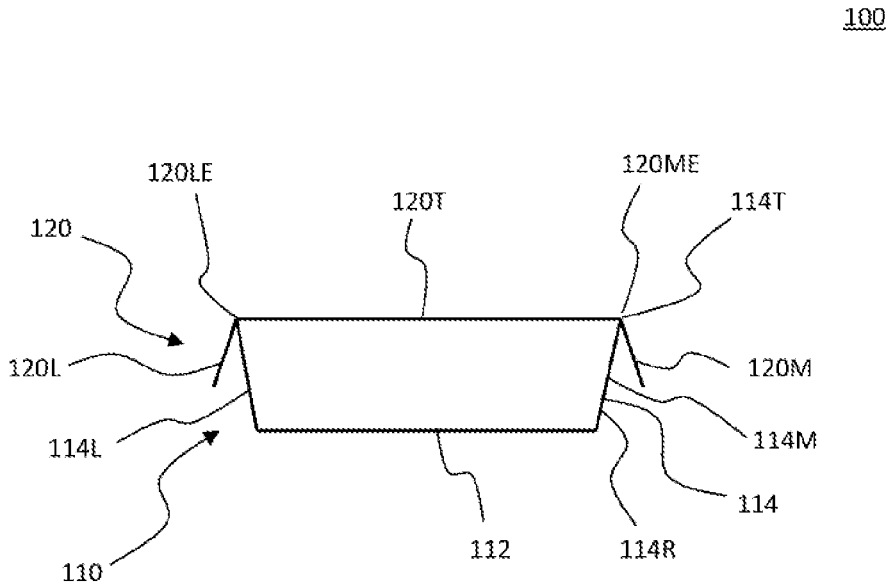
FIG. 2A shows a front cross-sectional view of food receptacle in FIG. 2.

FIG. 2A shows a front cross-sectional view of food receptacle 100 in FIG. 2. As shown in FIG. 2A, the perimeter edge 114T of the perimeter wall 114 may abut against the front edge 120FE (not shown in FIG. 2A), the left edge 120LE and the right edge 120ME of the top panel 120T. In this way, the perimeter wall 114, i.e. the four walls 114F, 114R,114L,114M, may be immobilized by the cover 120, i.e. by the front panel (not shown in FIG. 2A), the top panel 120T (attached to the rear wall 114R), the left side panel 120L and the right side panel 120M, such that the perimeter wall 114 may be locked into a fixed position and restrained from bending away from the base 112. Due to the immobilization of the perimeter wall 114, the food receptacle 100 is able to withstand higher load thereon compared to conventional food boxes, e.g. clam shell box.

Figure 3A:
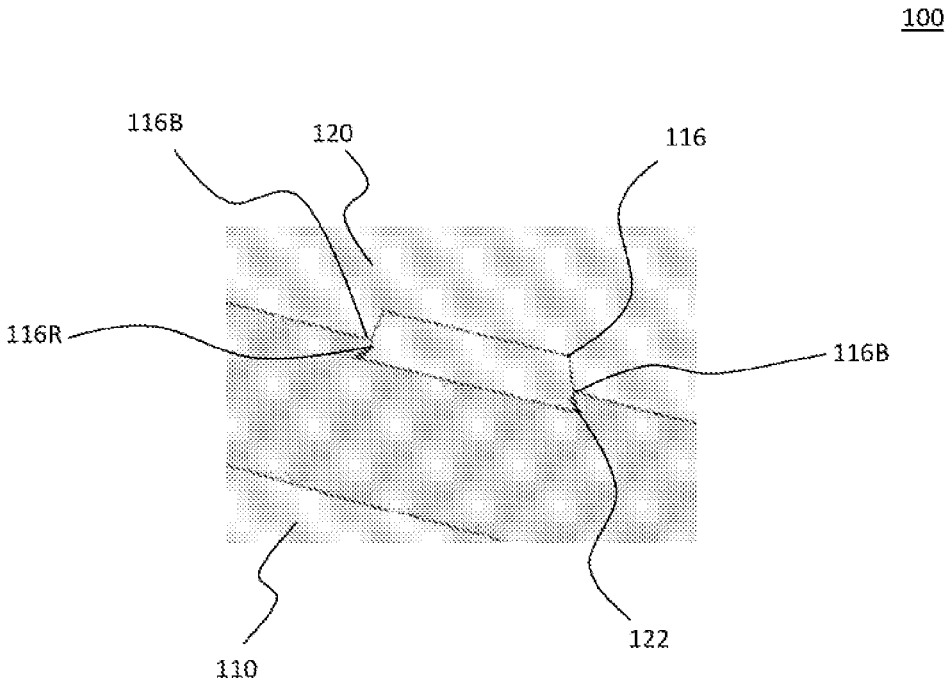
FIG. 3A shows an enlarged view of the tongue as shown in FIG. 1.

FIG. 3A shows an enlarged view of the tongue 116 as shown in FIG. 1. Tongue 116 may include a restrictor 116R adapted to restrict the tongue 116 from being withdrawn from the opening 122 after it is inserted therein. Restrictor 116R may be disposed at about a centre portion of the tongue 116 such that the restrictor 116R may be disposed above the opening 122 when the food receptacle 100 is closed. Restrictor 116R may be adapted to catch an edge of the opening 122 to restrict the tongue 116 from being withdrawn from the opening 122. Restrictor 116R may include a pair of barbs 116B formed on the tongue 116. Pair of barbs 116B may be disposed at a position where, when the tray 110 is covered by the cover 120, the pair of barbs 116B may be disposed above the opening 122. Pair of barbs 116B may be pointed towards the base 112 to allow the tongue 116 to be insert through the opening 122 easily but prevents the tongue 116 to be retracted from the opening 122 easily. In this way, the cover 120 may be locked onto the tray 110. Opening 122 may be an elongated slot and slightly wider than the width of the tongue 116. Opening 122 may have a trapezoidal profile where one longitudinal side of the opening 122 is longer than another longitudinal side. The shorter longitudinal side may be adjacent the front edge 120FE of the cover 120. In this way, the lateral sides of the opening 122 may be tapered to allow the tongue 116 to enter the opening 122 more easily. To open the food receptacle 100, the tongue 116 may be retracted from the opening 122 by adjusting the pair of barbs 116B to enter the opening 122 and/or by applying a slight force to dislodge the pair of barbs 116B from the opening 122.

Figure 3B:
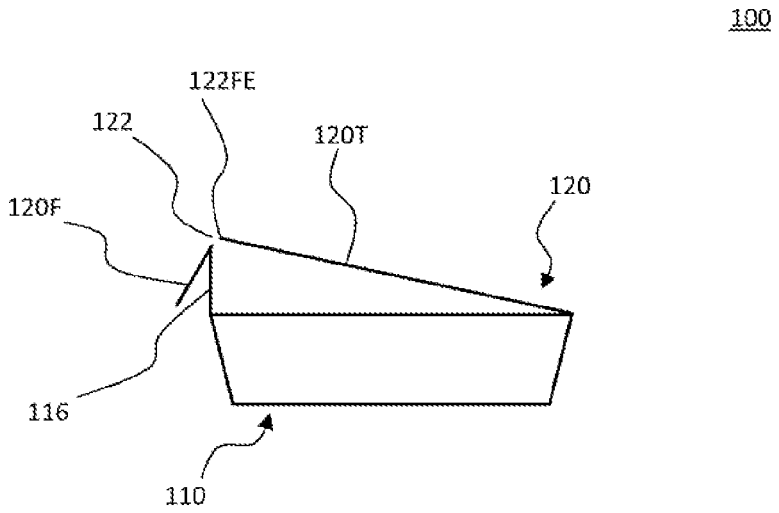
FIG. 3B shows a side view of the food receptacle in FIG. 1.

FIG. 3B shows a side sectional view of the food receptacle 100 in FIG. 1. Referring to FIG. 3B, the angle of the front panel 120F, being protruding outwardly from the top panel 120T, is able to overlap or extend beyond the tongue 116 when the cover 120 is covering the tray 110. In this way, the tongue 116 may be accommodated within the cover 120. When in contact with the tongue 116, the front panel 120F guides the tongue 116 towards the opening 122. When the tongue 116 reaches the opening 122, the tongue 116 may automatically be inserted into the opening 122 without any user assistance. Tongue 116 may be guided into the opening 122 even if the opening 122 is disposed on the top panel 120T of the cover 120 and adjacent to the front edge 120FE of the top panel 120T.

Figure 4A:
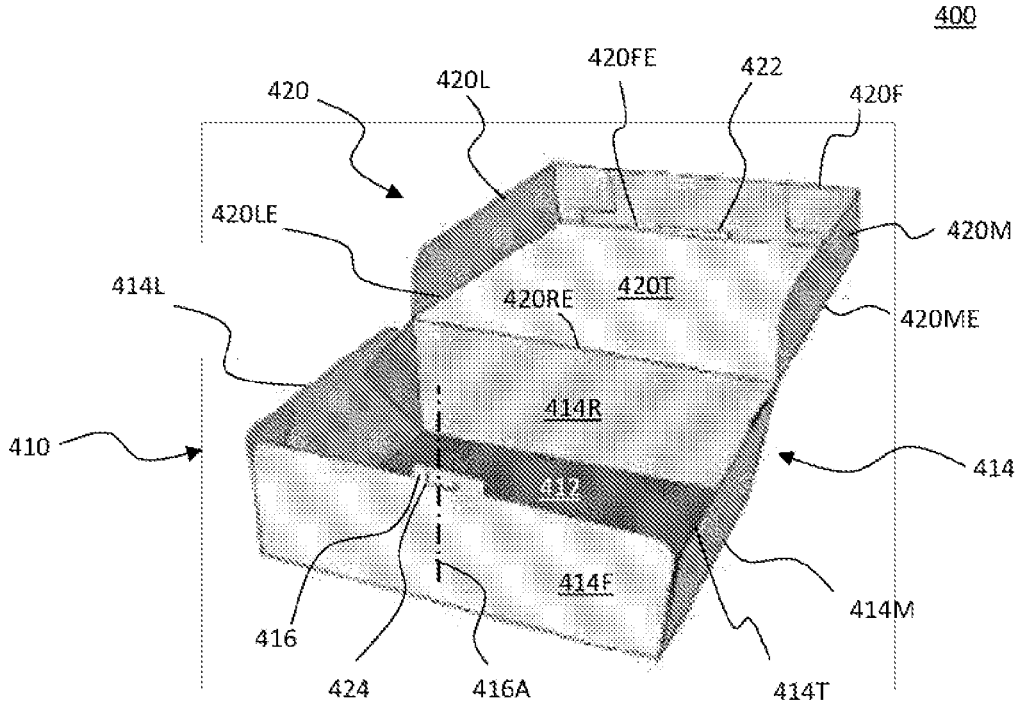
FIG. 4A shows a perspective view of an exemplary embodiment of the food receptacle in an opened configuration where the tray is not covered by the cover.

FIG. 4A shows a perspective view of an exemplary embodiment of the food receptacle 400 in an opened configuration where the tray 410 is not covered by the cover 420. Food receptacle 400 is identical to the food receptacle 100 in FIG. 1 except that the tongues 116,416 of the food receptacles are non-identical. As such, the same features in the embodiment have the same last two digits in their references.

As shown in FIG. 4A, the food receptacle 400 has a tray 410 having a base 412, a perimeter wall 414 extending therefrom, and a tongue 416 extending from the perimeter wall 414 along a longitudinal axis 416A and a cover 420 adapted to cover the tray 410. Cover 420 has an opening 422 adapted to receive the tongue 416 therethrough, such that the tongue 416 is inserted through the opening 422 when the tray 410 is covered by the cover 420. Tongue 416 may include a protrudable portion 424 adapted to protrude away from the longitudinal axis 416A.

As described in FIG. 1, the base 412 of the tray 410 may be a quadrilateral or a shape of any number of sides and the perimeter wall 414 which extends from the base 412 will have the same number of sides of the base 412. Referring to FIG. 4A, the base 412 may be rectangular such that the perimeter wall 414 may have four planar walls, i.e. the front wall 414F, rear wall 414R opposite the front wall 414F, a left side wall 414L and a right side wall 414M. Left side wall 414L and the right side wall 414M may extend from the front wall 414F to the rear wall 414R and spaced from each other. Perimeter wall 414 may include a perimeter edge 414T formed by the top edges of the front wall 414F, the rear wall 414R, the left side wall 414L and the right side wall 414M. Tongue 416 may extend upwardly from the front wall 414F. The four walls 414F,414R,414L,414M may have the same height such that the top edge of each of the four walls 414F,414R,414L,414M are disposed within a plane. In this way, the top panel 420T may be in contact with the perimeter wall 414 when the tray 410 is covered by the cover 420. The four walls 414F,414R,414L,414M may lean outwardly from the base 412 such that each wall may form an obtuse angle with the base 412.

Figure 4B:
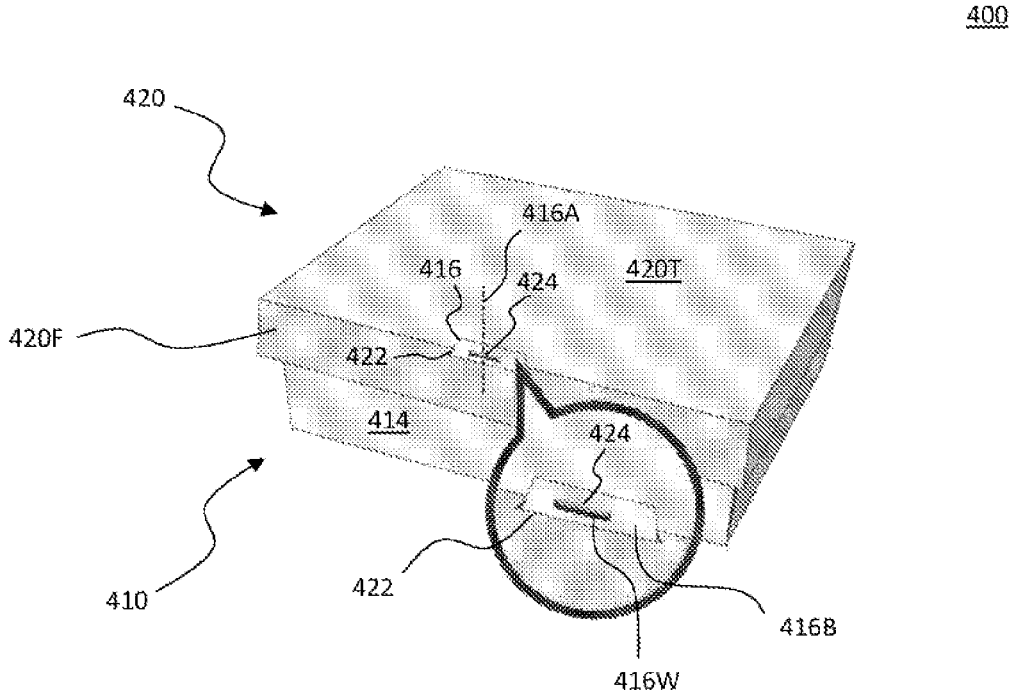
FIG. 4B shows a perspective view of an exemplary embodiment of the food receptacle in a closed configuration where the tray is covered by the cover.

Cover 420 may include the top panel 420T with a shape that corresponds to the shape of the base 412. As shown in FIG. 4A, the top panel 420T may be rectangular having a front edge 420FE, a rear edge 420RE opposite the front edge 420FE and a left edge 420LE and a right edge 420ME, both the left edge 420LE and the right edge 420ME extend from the front edge 420FE to the right edge 420ME. Cover 420 may have a front panel 420F extending from the front edge 420FE, a left side panel 420L extending from the left edge 420LE and a right side panel 420M extending from right edge 420ME. Left side panel 420L and the right side panel 420M may be connected to the front panel 420F to provide structural rigidity to the front panel 420F. The three panels, i.e. the front panel 420F, the left side panel 420L, the right side panel 420M, may have the same height such that the bottom edge of each panel may be disposed within a plane. The three panels 420F,420L,420R may have different heights. Cover 420 may be pivotally connected to the tray 410 along one edge of the top panel 420T, e.g. the rear edge 420RE of the top panel 420T, and rotatable between an opened position where the tray 410 is not covered by the cover 420 as shown in FIG. 4A and in a covered position where the tray 410 is covered by the cover 420 as shown in FIG. 4B. Cover 420 may be pivotally connected to the tray 410 at the rear wall 414R thereof. Alternatively, the cover 420 may be separated from the tray 410 as a two-piece configuration such that the cover 420 may have a rear panel opposite the front panel 420F and the left side panel 420L and the right side panel 420M extending from the front panel 420F to the rear panel. Front panel 420F may be tapered away from the top panel 420T such that the front panel 420F may form an obtuse angle with the top panel 420T. Left side panel 420L and the right side panel 420M may also be tapered away from the top panel 420T such that the left side panel 420L and the right side panel 420M may form an obtuse angle with the top panel 420T. Top panel 420T may be of the same size and shape as the area and shape formed by the perimeter edge 414T of the perimeter wall 414 of the tray 410 such that the perimeter edge 414T of the perimeter wall 414 may coincide with the perimeter of the top panel 420T.

FIG. 4B shows a perspective view of an exemplary embodiment of the food receptacle 400 in a closed configuration where the tray 410 is covered by the cover 420. FIG. 4B also shows an enlarged view of the locking mechanism comprising the tongue 416 and the opening 422. As shown in FIG. 4B, the protrudable portion 424 is adapted to protrude away from the longitudinal axis 416A, such that, when protruded, the protrudable portion 424 is adapted to protrude over the cover 420 (see FIG. 4C). When the tray 410 is covered by the cover 420, the protrudable portion 424 may be protruded over the top panel 420T to prevent the tongue 416 from being withdrawn from the opening 422. As shown in FIG. 4B, the tongue 416 may include a body 416B and the protrudable portion 424 may be pivotally connected to the body 416B. Protrudable portion 424 may be rotated from the body 416B to protrude from the body 416B such that the protrudable portion 424 may be disposed above the cover 420 and prevent the cover 420 from being lifted from the tray 410. In other words, the food receptacle 400 is being locked and prevented from being opened. Protrudable portion 424 may be rotated away from the perimeter wall 414 of the tray 410 or rotated upwardly from the body 416B of the tongue 416. As mentioned above, the tongue 416 may be guided by the front panel 420F of the cover 420 into the opening 422. Therefore, as the protrudable portion 424 is rotatable downwardly toward the body 416B, when the tongue 416 is being inserted through the opening 422, the protrudable portion 424 may be pushed back towards the body 416B by the opening 422 and the protrudable portion 424 passes through the opening 422. In this way, the tongue 416 may be inserted through the opening 422 without being obstructed by the protrudable portion 424. If the protrudable portion 424 is rotatable in the opposite direction, the protrudable portion 424 may obstruct the insertion of the tongue 416 through the opening 422. Protrudable portion 424 may be disposed within the body 416B and adapted to rotate out of the body 416B. Tongue 416 may include a window 416W within or a through hole having a top edge such that the protrudable portion 424 is housed within the window 416W and pivotally attached to the top edge of the window 416W. Protrudable portion 424 may be a flap adapted to fill the window 416W.

Figure 4C:
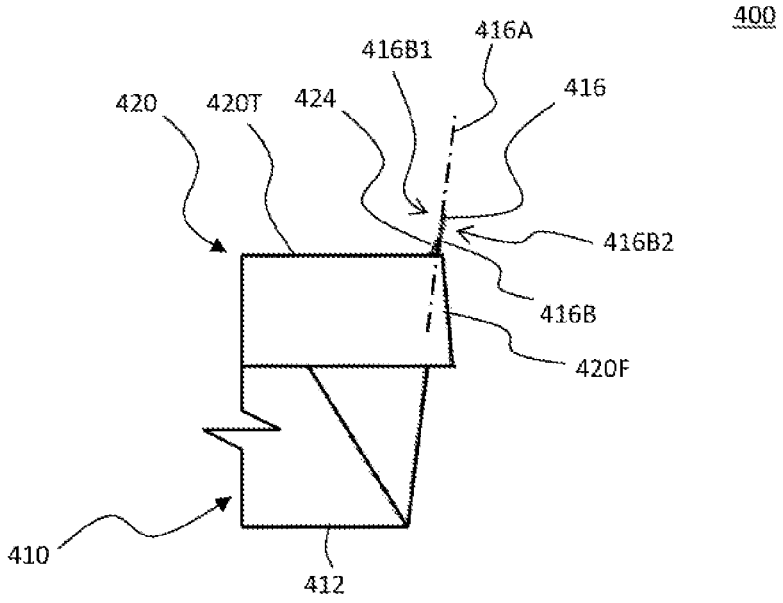
FIG. 4C shows a truncated side view of the food receptacle as shown in FIG. 4B.

FIG. 4C shows a truncated side view of the food receptacle 400 as shown in FIG. 4B. As shown in FIG. 4C, the protrudable portion 424 is adapted to protrude away from the longitudinal axis 416A, such that, when protruded, the protrudable portion 424 is adapted to abut the cover 420. When the tray 410 is covered by the cover 420, the protrudable portion 424 may be protruded to prevent the tongue 416 from being withdrawn from the opening 422 (not shown in FIG. 4C). Opening 422 may be disposed at the top panel 420T of the cover 420 and the tongue 416 may be inserted through the top panel 420T of the cover 420. Body 416B may include a front side 416B2 and a rear side 416B1 behind the front side 416B2, such that the protrudable portion 424 may be adapted to rotate from the front side 416B2 or the rear side 416B1. Front side 416B2 may be the side of the tongue 416 that faces away from the base 412 of the tray 410. Rear side 416B1 may be the side facing the base 412 of the tray 410. When the protrudable portion 424 protrudes from the rear side 416B1, the protrudable portion 424 may abut onto the top panel 420T of the cover 420. When the protrudable portion 424 protrudes from the front side 416B2, the protrudable portion 424 may abut onto the front panel 420F of the cover 420, thereby locking the cover 420 onto the tray 410. To unlock the food receptacle 400, the protrudable portion 424 may be retracted, e.g. pushed back, to align the protrudable portion 424 with the body 416B of the tongue 416. Thereafter, the cover 420 may be lifted to allow the tongue 416 to be retracted from the opening 422, hence allowing the food receptacle 400 to be opened.

Figure 4D:
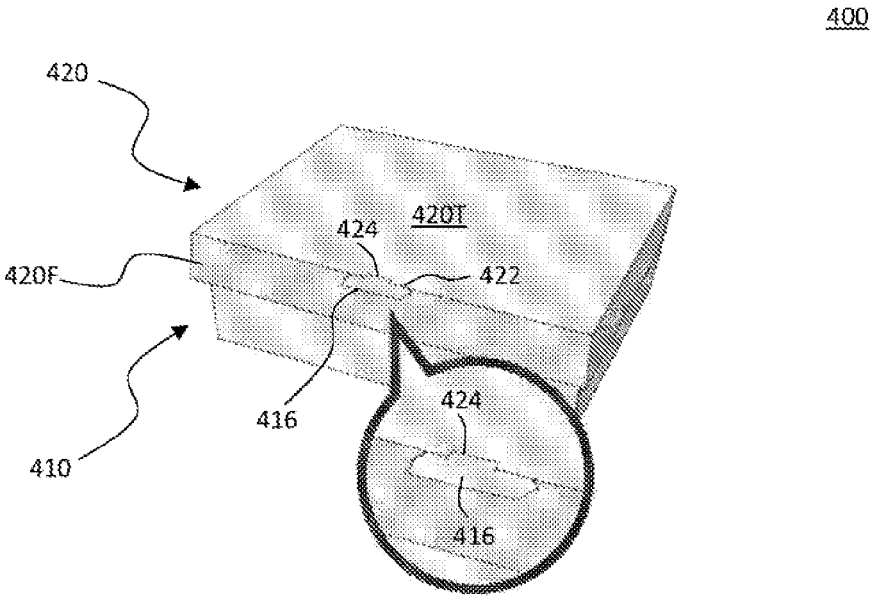
FIG. 4D shows a perspective view of an exemplary embodiment of the food receptacle.

FIG. 4D shows a perspective view of an exemplary embodiment of the food receptacle 400. Further, FIG. 4D shows an enlarged view of the locking mechanism comprising the tongue 416 and the opening 422 of the cover 420. As shown in FIG. 4D, the tongue 416 may be foldable, such the protrudable portion 424 may be protruded when the tongue 416 is folded. Tongue 416 may be adapted to fold towards or away from the top panel 420T of the cover 420. When the tongue 416 is inserted through the opening 422 and the protrudable portion 424 is above the top panel 420T of the cover 420, the tongue 416 may be folded toward the front panel 420F and the protrudable portion 424 may protrude above the top panel 420T and hence abuts the cover 420 and prevents the cover 420 from being lifted from the tray 410. When tongue 416 is folded towards the top panel 420T, the protrudable portion 424 may protrude above and abut the front panel 420F to prevent the cover 420 from being lifted from the tray 410.

Figure 4E:
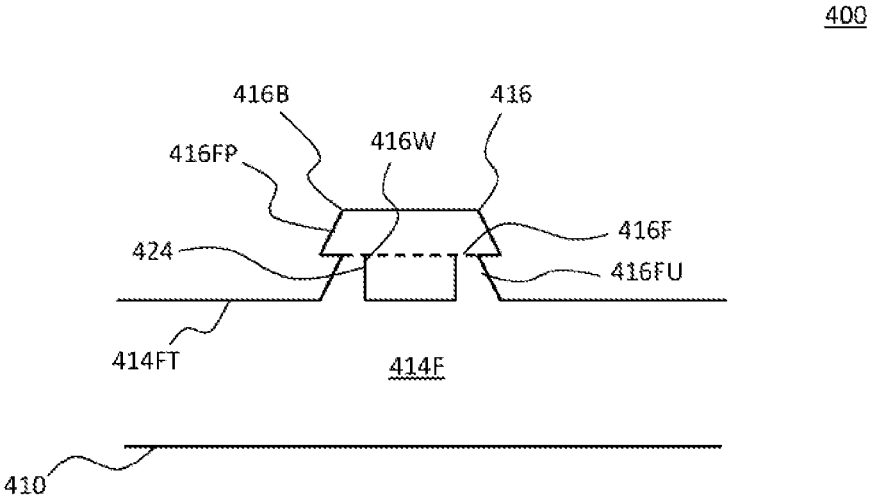
FIG. 4E shows a front view of an exemplary embodiment of the tongue in FIG. 4D.

FIG. 4E shows a front view of an exemplary embodiment of the tongue 416 in FIG. 4D. Tongue 416 may include a folding line 416F such that the tongue 416 may be folded along the folding line 416F. Folding line 416F may be parallel to a top edge 414FT of the front wall 414F of the tray 410. Folding line 416F may pass through the top part of the protrudable portion 424 such that, when the tongue 416 is folded, the protrudable portion 424 may protrude from the body 416B of the tongue 416. Folding line 416F may pass through the protrudable portion 424 at any point along the protrudable portion 424. In the embodiment where the tongue 416 includes a window 416W, the folding line 416F may be disposed at the top edge of the window 416W as shown in FIG. 4E. Folding line 416F may be disposed between the top edge and the bottom edge of the window 416W. Tongue 416 may be folded and the protrudable portion 424, i.e. the flap, may be rotated out of the window 416W (see FIG. 4F) and away from the body 416B of the tongue 416. Tongue 416 may be divided into a folded portion 416FP above the folding line 416F and base portion 416FU below the folding line 416F. Flap may be in the same plane as the folded portion 416FP of the tongue 416.

Figure 4F:
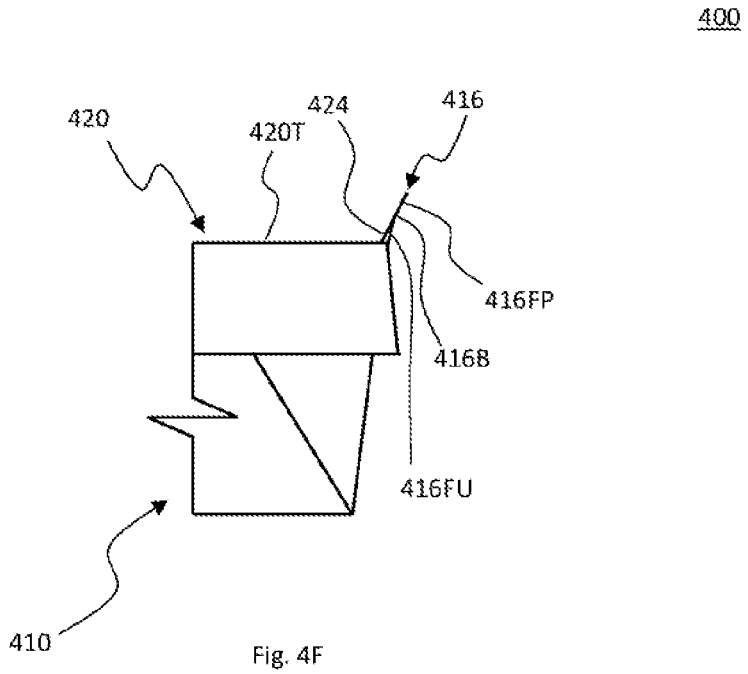
FIG. 4F shows a truncated side view of the food receptacle in FIG. 4D.

FIG. 4F shows a truncated side view of the food receptacle 400 in FIG. 4E. As shown in FIG. 4E, the tongue 416 may be folded away from the top panel 420T of the cover 420. As the folded portion 416FP is being folded away from the top panel 420T, the protrudable portion 424 may protrude over the top panel 420T of the cover 420. In this way, the protrudable portion 424 may protrude over the top panel 420T and abut the top panel 420T when the cover 420 is being lifted from the tray 410. Folded portion 416FP of the tongue 416 may be folded to be at an obtuse angle from the top panel 420T of the cover 420. Protrudable portion 424 may be pushed out of the window 416W (not shown in FIG. 4F), e.g. by a user's finger, such that the protrudable portion 424 is bent (along the folding line 416F (not shown in FIG. 4F)) with respect to the folded portion 416FP of the tongue 416. When the protrudable portion 424 is abutting against the top panel 420T of the cover 420, the folded portion 416FP may be maintained in the folded position. Folded portion 416FP may also be biased towards the unfolded position due to the elastic property of the material of the tongue 416. In this way, the protrudable portion 424 may be forced against the cover 420 to keep the cover 420 onto the tray 410. Top panel 420T may slide between the body 416B and the protrudable portion 424 as the cover 420 moves upwards such that the top panel 420T may be jammed therebetween, hence the cover 420 is securely locked by the tongue 416. To unlock the food receptacle 400, the tongue 416 may be straightened to retract the protrudable portion 424 towards the body 416B of the tongue 416. Referring to FIG. 4F, the folded portion 416FP may be unfolded by bending the folded portion 416FP to be aligned with the base portion 416FU of the tongue 416. Alternatively, the protrudable portion 424 may be pushed back into the window 416W to align the protrudable portion 424 with the base portion 416FU. When the protrudable portion 424 has been retracted, the cover 420 may be lifted so that the tongue 416 may be retracted from the opening 422 (not shown in FIG. 4F) thereby allowing the tray 410 to be uncovered.

Figure 4G:
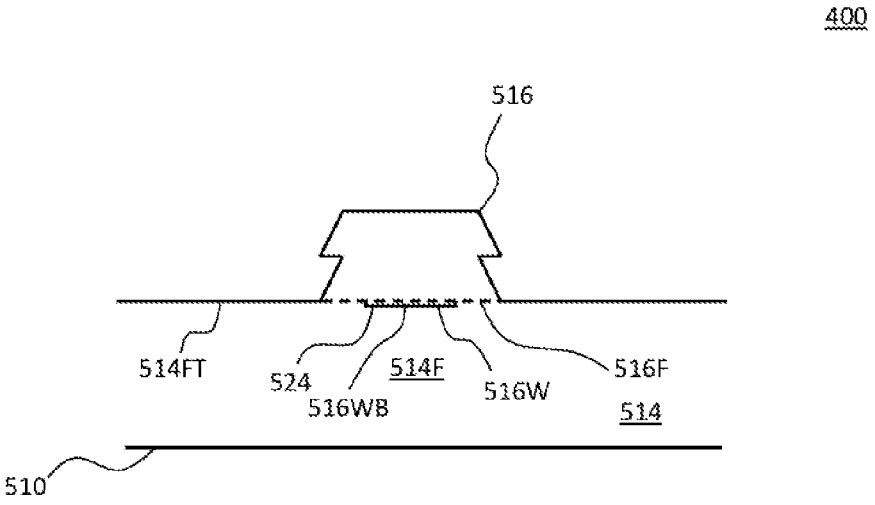
FIG. 4G shows a front view of an exemplary embodiment of the tongue of the food receptacle in FIG. 4D.

FIG. 4G shows a front view of an exemplary embodiment of the tongue 516 of the food receptacle 400 in FIG. 4D. Perimeter wall 514 may include a window 516W connected to the tongue 516 such that the protrudable portion 524 may extend from the tongue 516 and housed within the window 516W. Protrudable portion 524 may extend into the front wall 514F of the tray 510. Tongue 516 may be foldable along a folding line 516F that may be along the top edge 514FT of the front wall 514F of the tray 510. Folding line 516F may be disposed at the top edge of the window 516W as shown in FIG. 4G. Window 516W may have a bottom edge 516WB spaced from the folding line 516F. Folding line 516F may pass through the top part of the protrudable portion 524 such that, when the tongue 516 is folded, the protrudable portion 524 may rotate from the front wall 514F along the folding line 516F and rotated out of the window 516W (see FIG. 4H). When the tongue 516 is substantially parallel to top panel 520T of the cover 520 (not shown in FIG. 4G), the protrudable portion 524 may be substantially parallel to the top panel 520T of the cover 520 as well (see FIG. 4H).

Figure 4H:
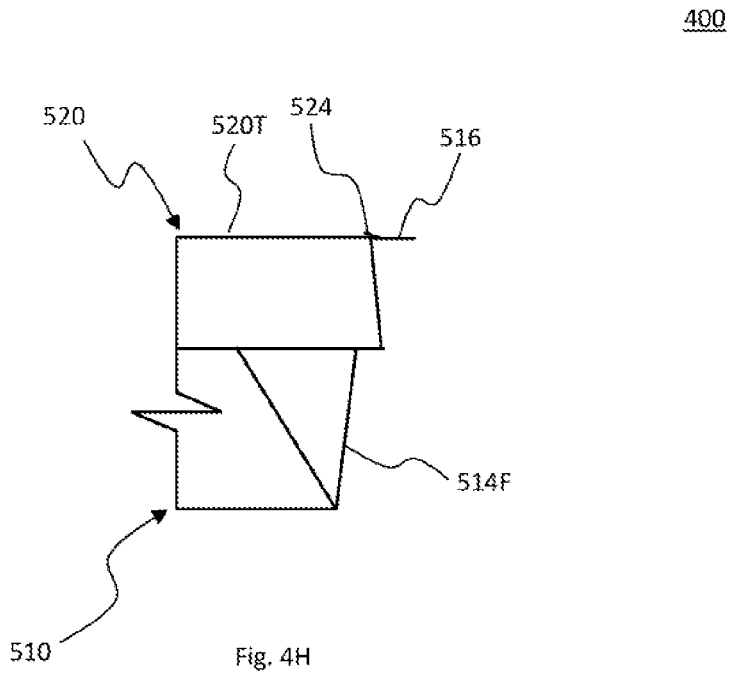
FIG. 4H shows a truncated side view of the food receptacle in FIG. 4G.

FIG. 4H shows a truncated side view of the food receptacle 400 in FIG. 4G. As shown in FIG. 4H, the tongue 516 may be folded away from the top panel 520T of the cover 520. As the tongue 516 is being folded away from the top panel 520T, the protrudable portion 524 may protrude out of the window 516W (not shown in FIG. 4H) and protrude over the top panel 520T of the cover 520. As shown in FIG. 4H, the protrudable portion 524 may be rotated towards the top panel 520T. In this way, the protrudable portion 524 may abut the top panel 520T when the cover 520 is being lifted from the tray 510. When the tongue 516 is being folded away from the top panel 520T, the protrudable portion 524 may be prevented from protruding out of the front wall 514F as the protrudable portion 524 may be slightly below the top panel 520T when the food receptacle 400 is covered and may be obstructed by the opening (not shown in FIG. 4H) of the cover 520 from protruding. However, as the protrudable portion 524 is relatively short and is therefore rigid, the protrudable portion 524 may be rigid enough to be forced out of the opening 522 and onto the top panel 520T of the cover 520 when the tongue 516 is folded away from top panel 520T. Tongue 516 may be folded to be substantially parallel to the top panel 520T of the cover 520 such that the protrudable portion 524, e.g. the flap, may extend parallelly to the top panel 520T of the cover 520 thereby protruding over the top panel 520T of the cover 520. When the protrudable portion 524 is abutting against the top panel 520T of the cover 520, the tongue 516 may be maintained in the folded position. Tongue 516 may also be biased towards the unfolded position due to the elastic property of the material of the tongue 516. In this way, the protrudable portion 524 may be forced against the cover 520 to keep the cover 520 onto the tray 510. As shown, the tongue 516 in the folded position may itself obstruct the cover 520 from opening. Protrudable portion 524 may maintain the tongue 516 in the folded position to improve the locking capability of food receptacle 400. To unlock the food receptacle 400, the tongue 516 may be straightened to be substantially parallel to or in line with the front wall 514F of the tray 510 so as to retract the protrudable portion 524 towards the front wall 514F, e.g. into the window 516W. Protrudable portion 524 may be obstructed by the top panel 520T from returning into the window 516W. In this case, the cover 520 may be depressed slightly when the tongue 516 is being straightened to allow the protrudable portion 524 to be retracted into the window 516W of the front wall 514F. As shown in FIG. 4H, the protrudable portion 524 may be retracted towards the front wall 514F. When the protrudable portion 524 has been retracted, the cover 520 may be lifted so that the tongue 516 may be retracted from the opening 522 (not shown in FIG. 4H) thereby allowing the tray 510 to be uncovered.

Figure 4J:
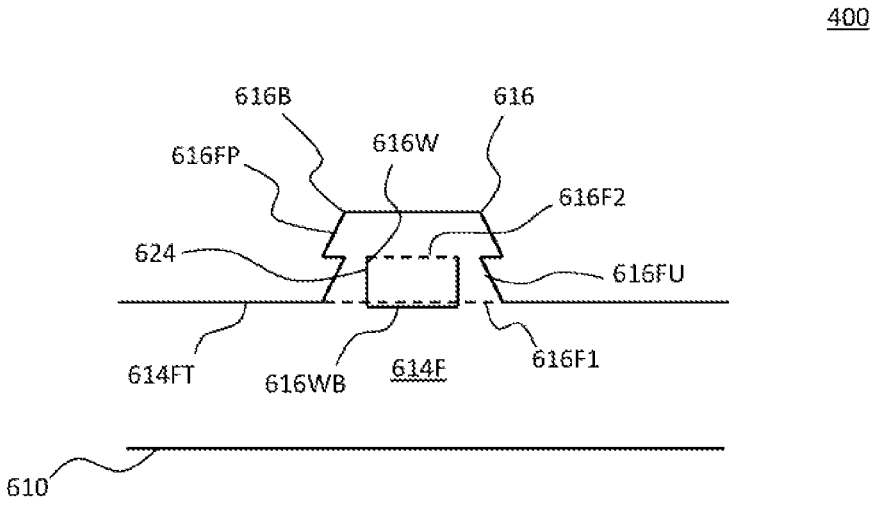
FIG. 4J shows a front view of an exemplary embodiment of the tongue in FIG. 4D.

FIG. 4J shows a front view of an exemplary embodiment of the tongue 616 in FIG. 4D. The exemplary embodiment in FIG. 4J may be a combination of the exemplary embodiments in FIG. 4E and FIG. 4G. Referring to FIG. 4J. Tongue 616 may be foldable along a first folding line 616F1 that may be along the top edge 614FT of the front wall 614F of the tray 610. Protrudable portion 624 may extend along the body 616B of the tongue 616 and into the front wall 614F of the tray 610. First folding line 616F1 may pass through the protrudable portion 624 at any point along the protrudable portion 624. Similarly, the window 616W may be disposed on the body 616B of the tongue 616 and extend into the front wall 614F. First folding line 616F1 may pass through the window 616W as shown in FIG. 4J. Window 616W may have a bottom edge 616WB spaced from and below the first folding line 616F1. First folding line 616F1 may be disposed between the top edge and the bottom edge 616WB of the window 616W. Tongue 616 may include a second folding line 616F2 that passes through the top edge of the window 616W. Protrudable portion 624 may include a rectangular flap that is pivotally connected to the body 616B along the second folding line 616F2 and extends from the top edge of the window 616W and into the front wall 614F. Protrudable portion 624 may include a thin portion disposed within the front wall 614F. Protrudable portion 624 may be pivotally connected to the body 616B and adapted to be rotated out of the window 616W along the second folding line 616F2. When the tongue 616 is folded away from the top panel 620T (not shown in FIG. 4J) along the first folding line 616F1, the protrudable portion 624 may be rotated out of the window 616W and protrude from body 616B and the front wall 614F of the tray 610. As the same time, the protrudable portion 624 may be pushed by the user, e.g. using a finger, towards the top panel 620T of the cover 620. Tongue 616 may be divided into a folded portion 616FP above the second folding line 616F2 and the base portion 616FU below the second folding line 616F2. Flap may be in the same plane as the folded portion 616FP of the tongue 616.

Figure 4K:
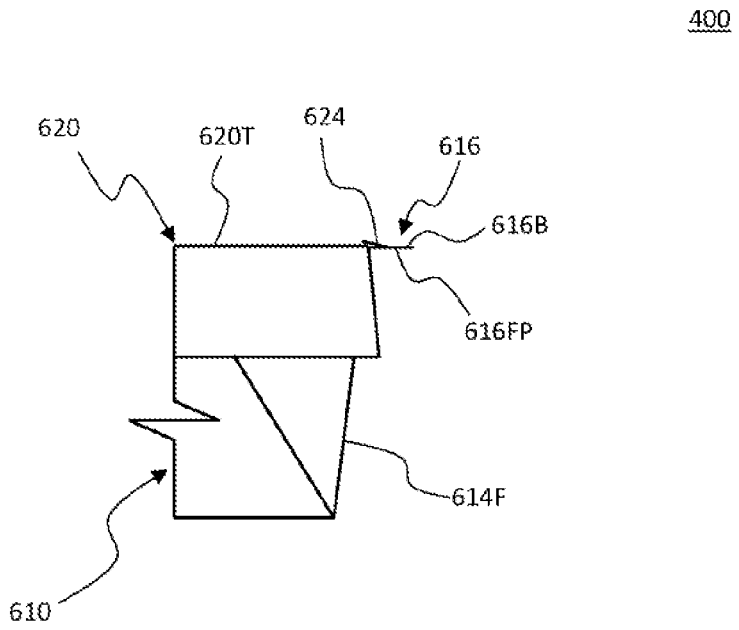
FIG. 4K shows a truncated side view of the food receptacle in FIG. 4J.

FIG. 4K shows a truncated side view of the food receptacle 400 in FIG. 4J. As shown in FIG. 4D, the tongue 616 may be folded away from the top panel 620T of the cover 620. As the folded portion 616FP is being folded away from the top panel 620T, the protrudable portion 624 may protrude over the top panel 620T of the cover 620. In this way, the protrudable portion 624 may abut the top panel 620T when the cover 620 is being lifted from the tray 610. Similar to the embodiment in FIG. 4G, the protrudable portion 624 may be obstructed by the opening (not shown in FIG. 4K) as it is below the top edge (not shown in FIG. 4K) of the front wall 614F. By folding the tongue 616 further away from the top panel 620T, the protrudable portion 624, being slightly below the opening, may forcibly be protruded out of the opening 622 (not shown in FIG. 4K). Compared to the earlier example in FIG. 4G, the length of the protrudable portion 624 is longer and therefore may be bent more easily and elastically and allow the protrudable portion 624 to overcome the obstruction by the opening 622 more easily. As the protrudable portion 624 is substantially longer than the protrudable portion 524 in FIG. 4G, the protrudable portion 624 may be more bendable and hence easier to be pushed out of the opening 422. Alternatively, the protrudable portion 624 may be pushed out of the window 616W by a user, e.g. using a finger of the user. When the tongue 616 is folded to be substantially parallel to the top panel 620T of the cover 620 such that the protrudable portion 624, e.g. the flap, may extend parallelly to the top panel 620T of the cover 620. When the protrudable portion 624 is abutting against the top panel 620T of the cover 620, the folded portion 616FP may be maintained in the folded position. Folded portion 616FP may also be biased towards the unfolded position due to the elastic property of the material of the tongue 616. In this way, the protrudable portion 624 may be forced against the cover 620 to keep the cover 620 onto the tray 610. Top panel 620T may slide between the body 616B and the protrudable portion 624 as the cover 620 moves upwards such that the top panel 620T may be jammed therebetween. Hence, the cover 620 may be securely locked by the tongue 616. As shown, the folded position of the tongue 616 may itself obstruct the cover 620 from opening. To unlock the food receptacle 400, the tongue 616 may be straightened to retract the protrudable portion 624 towards the body 616B of the tongue 616. Referring to FIG. 4K, the folded portion 616FP may be unfolded by bending the folded portion 616FP to be aligned with the base portion 616FU of the tongue 616. When the protrudable portion 624 has been retracted, the cover 620 may be lifted so that the tongue 616 may be retracted from the opening 622 (not shown in FIG. 4F) thereby allowing the tray 610 to be uncovered.

Food receptacle 400 as shown in any one of the embodiments above is easy to use, e.g. easy to cover and lock. For example, after the content, e.g. food, is placed into the tray 410 of the food receptacle 400, the cover 420 may be placed or rotated onto the tray 410. As the cover 420 approaches the tray 410, the tongue 416 may be guided by the cover 420 towards the opening 422 and the tongue 416 may eventually be inserted through the opening 422 when the tray 410 is covered by the cover 420. Thereafter, for the embodiment where the tongue 416 has a window 416W, the protrudable portion 424 may be pushed out of the window 416W to be protruded from the body 416B of the tongue 416 and/or the tongue 416 may be folded away from the top panel 420T to protrude the protrudable portion 424 over the top panel 420T of the cover 420. Consequently, the protrudable portion 424 prevents the cover 420 from being lifted from the tray 410 thereby locking the cover 420 onto the tray 410. To open the cover 420, the protrudable portion 424 may be pushed and rotated back towards the body 416B of the tongue 416 to streamline the protrudable portion 424 to the body 416B of the tongue 416 so that the opening 422 may pass over the protrudable portion 424 and the tongue 416 may be withdrawn from the opening 422. In this way, the cover 420 may be lifted, and the food receptacle 400 may be opened. Furthermore, the food receptacle 400 may be able to withstand a heavier load thereon compared to conventional food boxes. In this way, it is possible to stack more food receptacles onto one another to allow less carriers, e.g. plastic bag, from being used to carry the food receptacles.

A skilled person would appreciate that the features described in one example may not be restricted to that example and may be combined with any one of the other examples.

In the following examples, reference will be made to the figures, in which identical features are designated with like numerals.

The present invention relates to a food receptacle generally as herein described, with reference to and/or illustrated in the accompanying drawings.

The invention claimed is:

1. A food receptacle comprising:

a tray comprising a base, a perimeter wall extending therefrom and comprising a perimeter edge, and a tongue extending from the perimeter edge along a longitudinal axis, wherein the perimeter wall comprises a front wall, a rear wall opposite the front wall, a left side wall and a right side wall and the perimeter edge is formed by top edges of the front wall, the rear wall, the left side wall and the right side wall, wherein the front wall and the rear wall are respectively connected to the left side wall and the right side wall from the base to the perimeter edge, a cover adapted to cover the tray, the cover comprising a top panel comprising a front edge, a rear edge opposite the front edge, a left edge and a right edge, wherein the top panel of the cover is pivotally connected to the rear wall of the tray via the rear edge, wherein the cover further comprises a front panel extending from the front edge, a left panel extending from the left edge and connected to the front panel and a right panel extending from the right edge and connected to the front panel, wherein the perimeter edge is adapted to abut the front edge, the left edge and the right edge of the top panel, wherein the cover comprises an opening adapted to receive the tongue therethrough, wherein the tongue is inserted through the opening when the tray is covered by the cover, wherein the tongue comprises a body and a protrudable portion pivotally connected to the body, wherein the protrudable portion is disposed within the body and adapted to rotate out of the body and is adapted to protrude away from the longitudinal axis, wherein, when protruded, the protrudable portion is adapted to protrude over the top panel of the cover, wherein the perimeter wall comprises a window connected to the tongue, wherein the protrudable portion extends from the tongue and housed within the window, and wherein when the tray is covered by the cover, the protrudable portion is protruded to prevent the tongue from being withdrawn from the opening.

2. The food receptacle according to claim 1, wherein the opening is disposed on the front panel.

3. The food receptacle according to claim 2, wherein the opening is disposed adjacent the top panel.

4. The food receptacle according to claim 1, wherein the tongue comprises a window within and having a top edge, wherein the protrudable portion is housed within the window and pivotally attached to the top edge of the window.

5. The food receptacle according to claim 1, wherein the tongue is foldable, wherein the protrudable portion is protruded above and abut the top panel when the tongue is folded toward the front panel.

6. The food receptacle according to claim 1, wherein the tongue is adapted to fold along a folding line along the top edge of the front wall.

7. The food receptacle according to claim 6, wherein the folding line is disposed at the top edge of the window and passes through a top part of the protrudable portion, wherein the window and the protrudable portion extend from the tongue into the front wall, wherein, when the tongue is folded, the protrudable portion is rotated from the front wall along the folding line and rotated out of the window and abut the top panel of the cover.

8. The food receptacle according to claim 6, wherein the folding line is a first folding line passing through the protrudable portion, wherein the tongue comprises a second folding line passing through the top edge of the window, wherein the protrudable portion is pivotally connected to the body along the second folding line, wherein the window is disposed on the tongue and extends into the front wall and the protrudable portion extends from within the tongue into the front wall, wherein the tongue is foldable away from the top panel along the first folding line and the protrudable portion is rotatable out of the window and abut the top panel of the cover.

* * * * *